US012324465B2

(12) United States Patent
Mable et al.

(10) Patent No.: US 12,324,465 B2
(45) Date of Patent: Jun. 10, 2025

(54) ALL-PURPOSE FACE MASK

(71) Applicants: Jacqulyn Mable, Bronx, NY (US); Tiera Singleton, Bronx, NY (US)

(72) Inventors: Jacqulyn Mable, Bronx, NY (US); Tiera Singleton, Bronx, NY (US)

( * ) Notice: Subject to any disclaimer, the term of this patent is extended or adjusted under 35 U.S.C. 154(b) by 400 days.

(21) Appl. No.: 18/053,778

(22) Filed: Nov. 9, 2022

(65) Prior Publication Data

US 2023/0142568 A1 May 11, 2023

Related U.S. Application Data

(60) Provisional application No. 63/277,199, filed on Nov. 9, 2021.

(51) Int. Cl.
*A41D 13/11* (2006.01)

(52) U.S. Cl.
CPC ..... *A41D 13/11* (2013.01)

(58) Field of Classification Search
CPC .... A41D 13/11; A41D 13/1161; A41D 15/04; A45D 8/00; A62B 23/025
USPC ..... 128/863
See application file for complete search history.

(56) References Cited

U.S. PATENT DOCUMENTS

2020/0329792 A1* 10/2020 Howard ..... A41D 13/11
2021/0329994 A1* 10/2021 Sun ..... A41D 31/02
2021/0368874 A1* 12/2021 Eldibany ..... A62B 18/086
2022/0062670 A1* 3/2022 Maddox ..... A62B 23/025

* cited by examiner

*Primary Examiner* — Ophelia A Hawthorne
*Assistant Examiner* — Michael Milo
(74) *Attorney, Agent, or Firm* — Brennan, Manna & Diamond, LLC

(57) ABSTRACT

The present invention relates to a novel all-purpose face mask device. The device is a protective facial mask that is configured to protect a user from germs, bacteria, and pathogens. The all-purpose face mask comprises an outer layer, an inner layer, an adjustable right ear loop, an adjustable left ear loop, and an opening through both the inner layer and the outer layer, configured to be positioned near the mouth of a user when the face mask is worn. Further, the device comprises a flap component for closing the opening. The flap component can be secured in an open configuration via a twist tie mechanism, buttons, snaps, etc. In this way, the flap component can be opened when a user is consuming food or beverages without fully removing the face mask.

10 Claims, 3 Drawing Sheets

ALL-PURPOSE FACE MASK

CROSS-REFERENCE TO RELATED APPLICATION

The present application claims priority to, and the benefit of, U.S. Provisional Application No. 63/277,199, which was filed on Nov. 9, 2021, and is incorporated herein by reference in its entirety.

FIELD OF THE INVENTION

The present invention relates generally to the field of all-purpose face mask devices. More specifically, the present invention relates to an improved all-purpose face mask device that provides users with an improved face mask featuring a flap opening, which opens to allow for the consumption of food and beverages without full mask removal. Accordingly, the present disclosure makes specific reference thereto. Nonetheless, it is to be appreciated that aspects of the present invention are also equally applicable to other like applications, devices, and methods of manufacture.

BACKGROUND

The emergence of the COVID-19 pandemic placed increased pressure on the importance of mitigating the spread of communicable diseases. While staying home during illnesses or covering a cough have long been common conventions, many individuals now consider the usage of facial masks as an equally essential component in mitigating the spread and exposure of airborne diseases. Specifically, viral and bacterial transmission, leading to the onset of diseases, is known to take place primarily through facial openings, such as the eyes, nose, mouth, and ears.

Further, airborne pathogens can be incredibly dangerous to inhale, leading to germs, viruses, bacteria, etc., being spread from person to person in highly active public places. People can wear personal protective equipment (PPE), such as a face mask to help prevent inhalation and exhalation of these dangerous particulates. However, the face mask covers the entirety of the nose and mouth making it impossible to consume food and beverages without taking off the face mask completely. Further, fully removing the face mask can leave people at risk for serious illnesses.

Generally, to prevent the spread of infectious diseases, people are often advised to follow social distancing guidelines, maintain personal hygiene, wear protective face masks and more. Wearing protective face masks in public areas prevents the spread of infectious diseases, as the mask acts as a barrier between the oral and nasal passages of the user and the outer environment and protects the users from transmission of germs, viruses, bacteria, and other harmful pathogens. The use of face masks avoids contact between those who are infected with various viruses, bacteria or the like, so as to stop or slow down the rate and extent of disease transmission.

Typically, a face mask comprises a layer of protective fabric designed to cover the nose and mouth region and includes ear loops to allow a user to easily keep the face mask in place. However, the conventional face mask must be removed when consuming food and/or beverages, thus exposing users to the risk of serious illnesses. Specifically, removing standard face masks while eating or drinking, fails to provide complete protection from the inhalation of germs, bacteria, viruses, and other airborne pathogens that are incredibly dangerous and can lead to the spreading of serious illnesses.

Therefore, there exists a long-felt need in the art for an all-purpose face mask device which provides users with an improved face mask featuring a flap opening, which opens to allow for consumption of food and beverages without full mask removal. There is also a long-felt need in the art for an all-purpose face mask device that features a twist-tie opening flap on the front that can be opened as desired for consuming food and beverages. Further, there is a long-felt need in the art for an all-purpose face mask device that includes several different sizes, styles, colors, and designs to fit both adults and children. Moreover, there is a long-felt need in the art for a device that functions as a safe and convenient face mask for students, restaurant patrons, etc. Further, there is a long-felt need in the art for an all-purpose face mask device that improves safety in public spaces and reduces the chance of spreading harmful airborne pathogens while still enjoying food and beverages. Finally, there is a long-felt need in the art for an all-purpose face mask device that provides users with a device that can be especially useful for anyone eating or drinking in public.

The subject matter disclosed and claimed herein, in one embodiment thereof, comprises an all-purpose face mask device. The device is a protective facial mask that is configured to protect a user from germs, bacteria, and pathogens. The all-purpose face mask comprises an outer layer, an inner layer, an adjustable right ear loop, an adjustable left ear loop, and an opening through both the inner layer and the outer layer, configured to be positioned near the mouth of a user when the face mask is worn. Further, the device comprises a flap component for closing the opening. The flap component can be secured in an open configuration via a twist tie mechanism, buttons, snaps, etc. In this way, the flap component can be opened when a user is consuming food or beverages without fully removing the face mask. The face mask still covers the nose area, but the mouth area is left open. It can also be slightly lifted to insert food or a straw. Thus, the face mask is especially useful for anyone eating or drinking in public, school students eating in a cafeteria, people riding on public transportation, train, buses, planes, etc.

In this manner, the all-purpose face mask device of the present invention accomplishes all of the foregoing objectives and provides users with a device that provides the maximum protection against the spread of harmful airborne pathogens, even while eating. The device provides users with a convenient way to wear a face mask and still be able to consume food and beverages without completely removing the face mask. The device is available in various sizes, styles, and colors, and can be customized based on a user's preferences.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises an all-purpose face mask device. The device is a protective facial mask that is configured to protect a user from germs, bacteria, and pathogens. The all-purpose face mask comprises a fabric layer, adjustable right and left ear loops, and an opening configured to be positioned near the mouth of a user when the face mask is worn. Further, the device comprises a flap component for closing the opening. The flap component can be secured in an open configuration via a twist tie mechanism, buttons, snaps, etc. In this way, the flap component can be opened when a user is consuming food or beverages without fully removing the face mask. The face mask still covers the nose area but the mouth area is left open or it can be lifted slightly to insert food or a straw.

In one embodiment, the all-purpose face mask device comprises a fabric layer. The fabric layer is comprised of a comfortable fabric material, or any other suitable material as is known in the art. The fabric layer is sized and shaped to cover a user's nose and mouth for maximum protection against spreading harmful airborne pathogens.

In one embodiment, the all-purpose face mask device comprises a double layered anti-bacterial face mask. Specifically, the face mask device comprises an inner layer configured to contact a user's nose and mouth and an outer layer disposed on the inner layer. An opening in the device would go through the inner and the outer layers.

In one embodiment, the all-purpose face mask device comprises adjustable, elastic bands that are secured to the fabric layer and then are positioned around a user's ears. The adjustable, elastic bands are utilized to ensure the face mask device covers a user's nose and mouth area and remains in place.

In one embodiment, the all-purpose face mask device comprises an opening configured to be positioned near the mouth of a user when the face mask is worn. The opening is typically horizontally or vertically positioned, aligning with the width of a user's mouth, but can be any suitable shape or size as is known in the art.

In one embodiment, the all-purpose face mask device comprises a flap component for closing the opening. In a closed configuration, the flap component is secured via twist ties, snaps, buttons, Velcro (aka hook and loop fasteners), etc. Furthermore, the flap component can be secured in an open configuration via a twist tie mechanism, buttons, snaps, etc. In this way, the flap component can be opened and held open when a user is consuming food or beverages without fully removing the face mask.

In yet another embodiment, the all-purpose face mask device comprises a plurality of indicia.

In yet another embodiment, a method of reducing the chance of spreading harmful airborne pathogens while consuming food and beverages is described. The method includes the steps of providing an all-purpose face mask device comprising a fabric layer, adjustable right and left ear loops, and an opening positioned near the mouth of a user when the face mask is worn, which can be closed with a flap component. The method also comprises positioning the face mask device on a user's face with the ear loops secured behind a user's ears. Further, the method comprises securing the flap component in an open configuration via a securing means. Finally, eating food and/or drinking beverages while wearing the face mask device.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
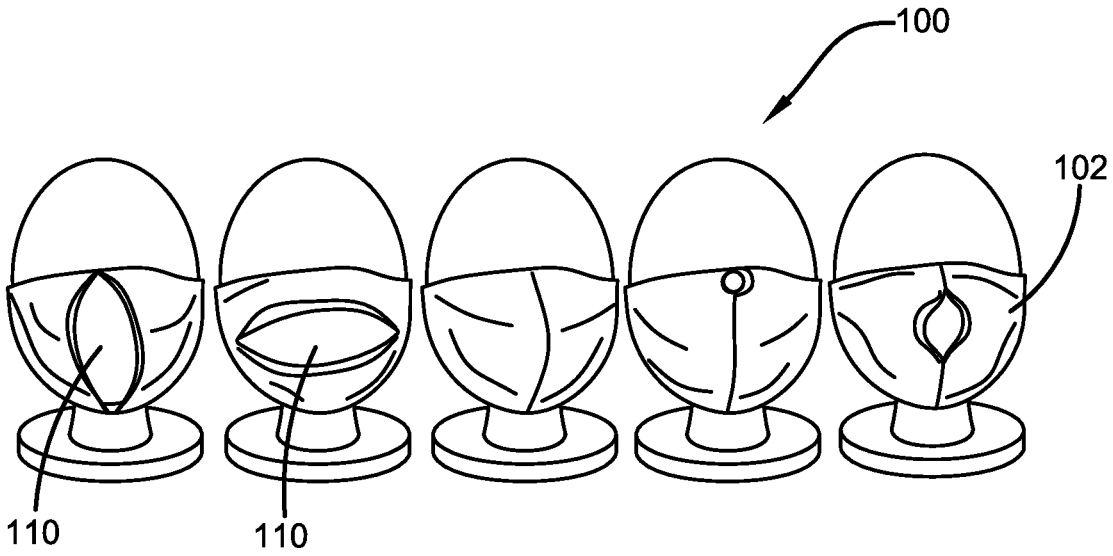
FIG. 1 illustrates a perspective view of one embodiment of the all-purpose face mask device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for an all-purpose face mask device which provides users with an improved face mask featuring a flap opening, which opens to allow for consumption of food and beverages without full mask removal. There is also a long-felt need in the art for an all-purpose face mask device that features a twist-tie opening flap on the front that can be opened as desired for consuming food and beverages. Further, there is a long-felt need in the art for an all-purpose face mask device that includes several different sizes, styles, colors, and designs to fit both adults and children. Moreover, there is a long-felt need in the art for a device that functions as a safe and convenient face mask for students, restaurant patrons, public transportation, etc. Further, there is a long-felt need in the art for an all-purpose face mask device that improves safety in public spaces and reduces the chance of spreading harmful airborne pathogens while still enjoying food and beverages. Finally, there is a long-felt need in the art for an all-purpose face mask device that provides users with a device that can be especially useful for anyone eating or drinking in public.

The present invention, in one exemplary embodiment, is a novel all-purpose face mask device. The all-purpose face mask comprises an outer layer, an inner layer, an adjustable right ear loop, an adjustable left ear loop, and an opening through both the inner layer and the outer layer, configured to be positioned near the mouth of a user when the face mask is worn. Further, the device comprises a flap component for closing the opening. The flap component can be secured in an open configuration via a twist tie mechanism, buttons, snaps, etc. In this way, the flap component can be opened for when a user is consuming food or beverages without fully removing the face mask. The present invention also includes a novel method of reducing the chance of spreading harmful airborne pathogens while consuming food and beverages. The method includes the steps of providing an all-purpose face mask device comprising a fabric layer, adjustable right and left ear loops, and an opening positioned near the mouth of a user when the face mask is worn, which can be closed with a flap component. The method also comprises positioning the face mask device on a user's face with the ear loops secured behind a user's ears. Further, the method comprises securing the flap component in an open configuration via a securing means. Finally, eating food and/or drinking beverages while wearing the face mask device.

Referring initially to the drawings, FIG. 1 illustrates a perspective view of one embodiment of the all-purpose face mask device 100 of the present invention. In the present embodiment, the all-purpose face mask device 100 is an improved face mask device 100 that reduces the spread of harmful airborne pathogens. Specifically, the device 100 is an improved face mask. The all-purpose face mask device 100 comprises a fabric layer 102 with adjustable right and left ear loops 104 for securing the face mask to a user. Once in place, users can consume food and beverages without fully removing the face mask device 100. Thus, the face mask device 100 still covers the nose area, but the mouth area is left open when users are consuming food and beverages.

Figure 2:
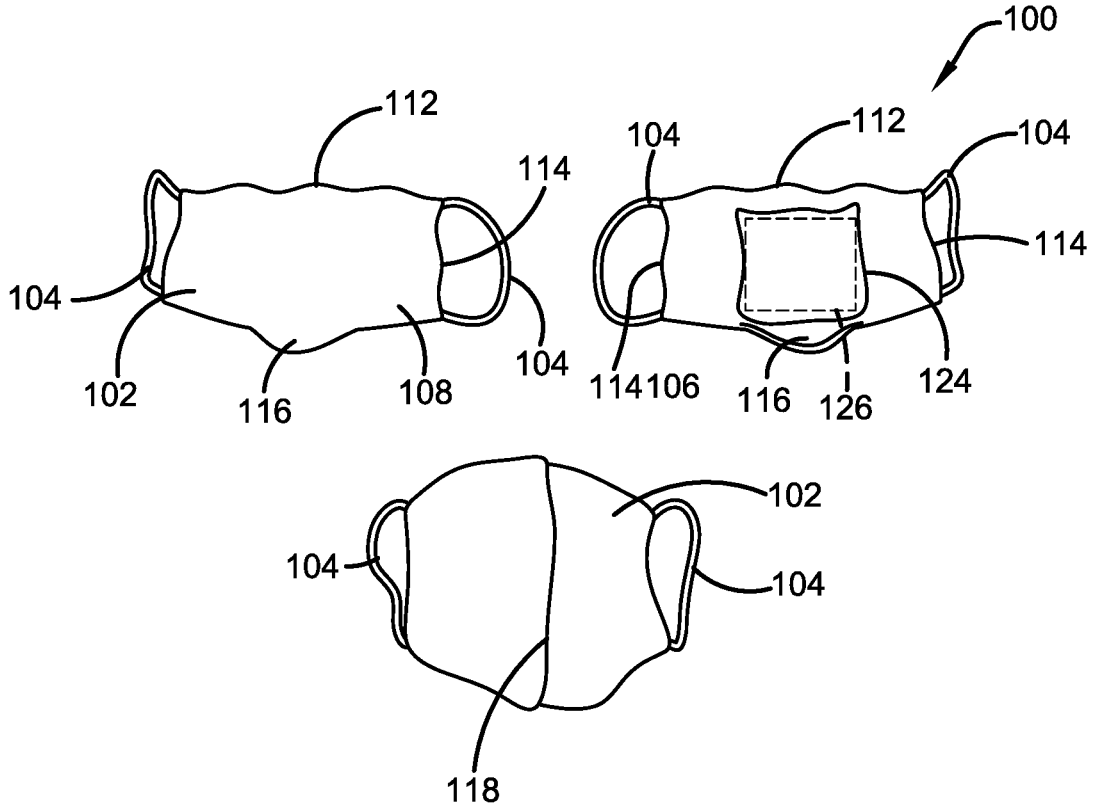
FIG. 2 illustrates a perspective view of one embodiment of the all-purpose face mask device of the present invention showing the different styles and colors available for the face mask in accordance with the disclosed architecture.
Figure 3:
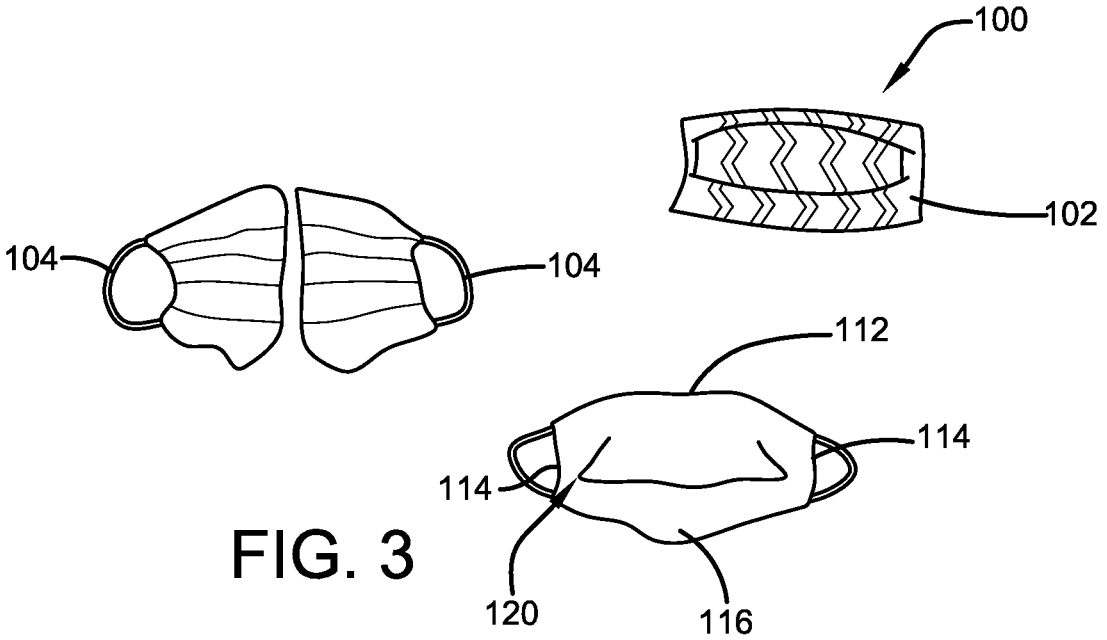
FIG. 3 illustrates a perspective view of one embodiment of the all-purpose face mask device of the present invention showing the various securing mechanisms for the flap component in use in accordance with the disclosed architecture.

As shown in FIGS. 2-3, the all-purpose face mask device 100 comprises a fabric layer 102. The fabric layer 102 is comprised of a comfortable fabric material, or any other suitable material as is known in the art, such as thin cotton, polypropylene, and polyester, etc., for a disposable embodiment, and/or a thicker cotton or cloth material for non-disposable use. Further, the comfortable fabric material can include, but is not limited to: vinyl, canvas, cashmere, chenille, chiffon, cotton, damask, jersey, lace, linen, wool, modal, polyester, satin, silk, spandex, suede, tweed, twill, velvet, acrylic, modacrylic, nylon, polypropylene, polyurethane, polyvinyl chloride, polyethylene, vinylidene, benzoate, aramid, rayon, acetate, triacetate, etc. The fabric material may also be comprised of an anti-bacterial/anti-microbial coating to ensure the protection from airborne pathogen entry.

Additionally, the face mask device 100 is breathable and stretchable such that it molds itself to a user's face. Specifically, the fabric layer 102 is sized and shaped to cover a user's nose and mouth for maximum protection against spreading harmful airborne pathogens. The face mask device 100 has a top edge 112 designed to adhere to a user's face, opposing side edges 114, and a chin cover 116 to provide complete protection to the user.

In one embodiment, the all-purpose face mask device 100 comprises a double layered anti-bacterial face mask. Specifically, the face mask device 100 comprises an inner layer 106 configured to contact a user's nose and mouth and an outer layer 108 disposed on the inner layer 106. The outer layer 108 of the face mask device 100 has the shape and contour substantially similar to the inner layer 106. Both the outer layer 108 and the inner layer 106 are sewn at the edges and are adhered to each other via any suitable fastening means as is known in the art. Further, an opening 110 in the device 100 would go through the inner 106 and the outer 108 layers. Thus, the two-layer structure of the face mask device 100 maximizes a user's protection against the inhalation and spread of germs, viruses, and bacteria.

Furthermore, the all-purpose face mask device 100 comprises adjustable, elastic ear loops 104 that are secured to the fabric layer 102 and then are positioned around a user's ears. The adjustable, elastic bands 104 are utilized to ensure the face mask device covers a user's nose and mouth area and remains in place. Specifically, the face mask device 100 comprises an adjustable left ear loop 104 and an adjustable right ear loop 104. The ear loops 104 are soft and elastic and are adjustable to fit all sizes.

Figure 4:
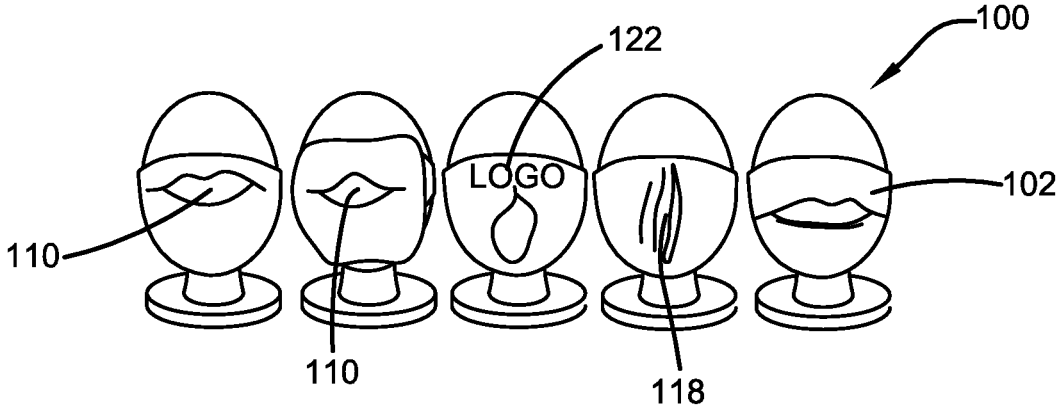
FIG. 4 illustrates a perspective view of one embodiment of the all-purpose face mask device of the present invention showing the flap component in an open configuration in accordance with the disclosed architecture.
Figure 5:
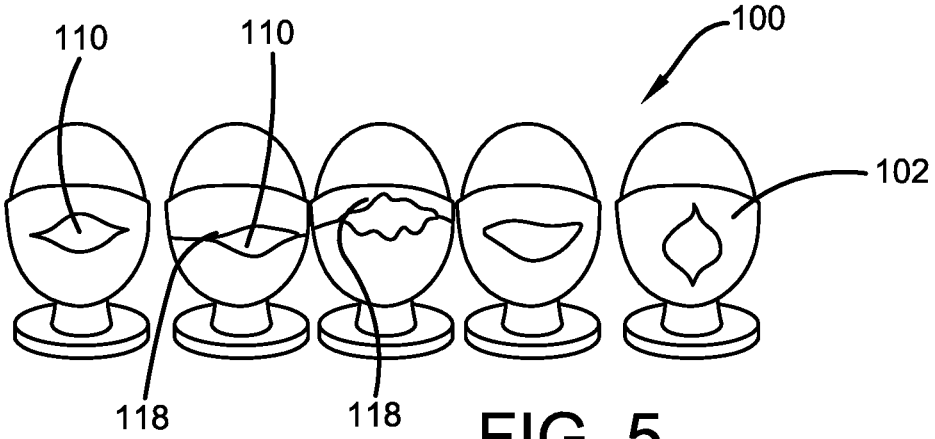
FIG. 5 illustrates a perspective view of one embodiment of the all-purpose face mask device of the present invention in use in accordance with the disclosed architecture.

As shown in FIGS. 4-5, the all-purpose face mask device 100 comprises an opening 110 configured to be positioned near the mouth of a user when the face mask device 100 is worn. The opening 110 is typically horizontally positioned, aligning with the width of a user's mouth, but can be any suitable shape or size as is known in the art.

Further, the all-purpose face mask device 100 comprises a flap component 118 for closing the opening 110. In a closed configuration, the flap component 118 is secured via twist ties, snaps, buttons, Velcro, etc., or any other suitable securing means as is known in the art. Furthermore, the flap component 118 can be secured in an open configuration via a twist tie mechanism, buttons, snaps, Velcro, etc., or any other suitable securing means as is known in the art. In this way, the flap component 118 can be opened and held open when a user is consuming food or beverages without fully removing the face mask device 100.

In some embodiments, such as shown in a typical flat face mask, design pleats 120 can be included to provide facial flexibility for improved fit and a greater surface area for a lower pressure drop per breath. In addition, different sized masks (i.e., S, M, L, XL) can be offered for an improved fit, comfort, and feel.

In yet another embodiment, the all-purpose face mask device 100 comprises a plurality of indicia 122. The fabric layer 102 of the device 100 may include advertising, a trademark, or other letters, designs, or characters, printed, painted, stamped, or integrated into the fabric layer 102, or any other indicia 122 as is known in the art. Specifically, any suitable indicia 122 as is known in the art can be included, such as, but not limited to, patterns, logos, emblems, images, symbols, designs, letters, words, characters, animals, advertisements, brands, etc., that may or may not be face mask or brand related.

In another embodiment, the fabric layer 102 of the face mask device 100 comprises a filter pocket 124 that houses at least one filter 126 to ensure clean ventilation for the user. The filter 126 may be made of any disposable and breathable material, such as, but not limited to: polypropylene, coffee filters, HEPA filters, etc.

Figure 6:
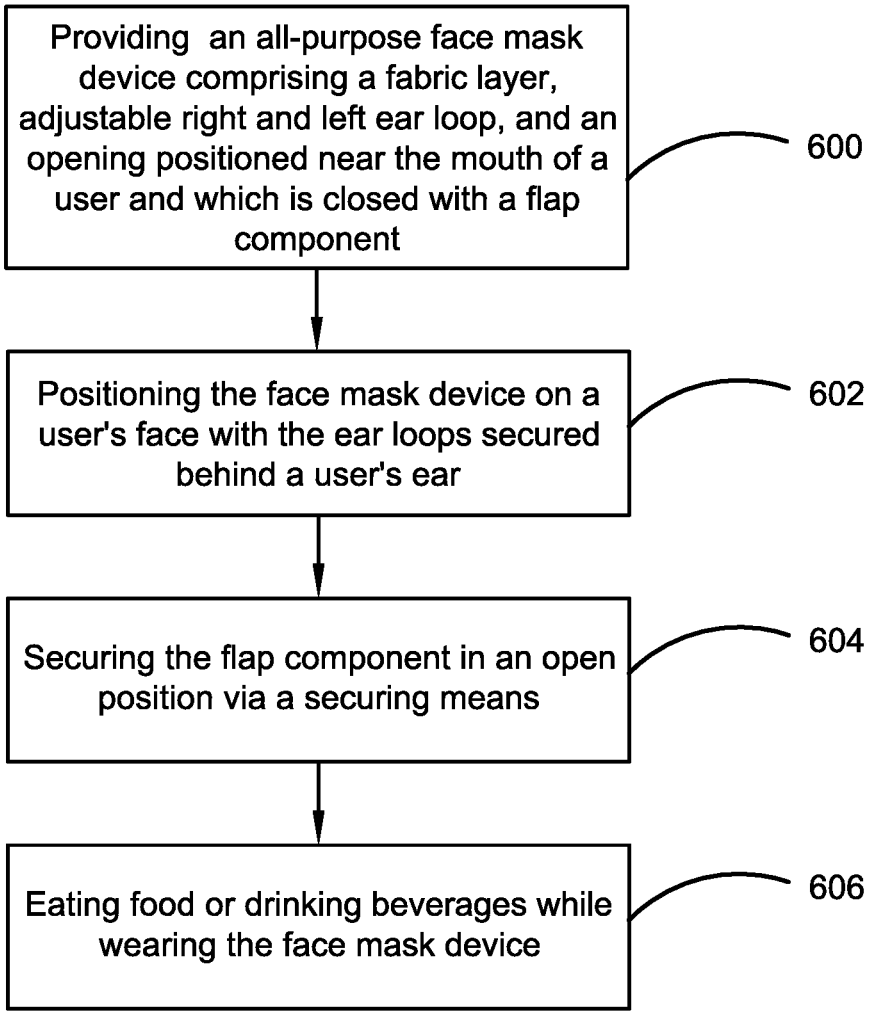
FIG. 6 illustrates a flowchart showing the method of reducing the chance of spreading harmful airborne pathogens while consuming food and beverages in accordance with the disclosed architecture.

FIG. 6 illustrates a flowchart of the method of reducing the chance of spreading harmful airborne pathogens while consuming food and beverages. The method includes the steps of at 600, providing an all-purpose face mask device comprising a fabric layer, adjustable right and left ear loops, and an opening positioned near the mouth of a user when the face mask is worn, which can be closed with a flap component. The method also comprises at 602, positioning the face mask device on a user's face with the ear loops secured behind a user's ears. Further, the method comprises at 604, securing the flap component in an open configuration via a securing means. Finally, at 606, eating food and/or drinking beverages while wearing the face mask device.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "all-purpose face mask device", "face mask device", and "device" are interchangeable and refer to the all-purpose face mask device 100 of the present invention.

Notwithstanding the foregoing, the all-purpose face mask device 100 of the present invention can be of any suitable size and configuration as is known in the art without affecting the overall concept of the invention, provided that it accomplishes the above-stated objectives. One of ordinary skill in the art will appreciate that the all-purpose face mask device 100 as shown in FIGS. 1-6 are for illustrative purposes only, and that many other sizes and shapes of the all-purpose face mask device 100 are well within the scope of the present disclosure. Although the dimensions of the all-purpose face mask device 100 are important design parameters for user convenience, the all-purpose face mask device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An all-purpose face mask device that reduces the spread of harmful airborne pathogens, the all-purpose face mask device comprising:

a fabric layer;

two ear loops secured to the fabric layer;

an opening in the fabric layer; and a flap component for closing the opening;

wherein the two ear loops are configured to be placed around a user's ears to secure the fabric layer in place on a user;

wherein the all-purpose face mask device is configured to cover a nose and a mouth area of the user; and further when in place, the user consumes food and beverages without fully removing the all-purpose face mask device; wherein the fabric layer comprises inner and an outer layers consisting of a plurality of indicia, an antibacterial or anti-microbial coating to ensure protection from airborne pathogen entry, a plurality of design pleats for flexibility, a filter pocket that houses at least one filter, and being sewn at edges and adhered to each other via a fastening means.

2. The all-purpose face mask device of claim 1, wherein the two ear loops are adjustable.

3. The all-purpose face mask device of claim 2, wherein the opening is horizontally positioned, aligning with a width of a user's mouth.

4. The all-purpose face mask device of claim 3, wherein in a closed configuration, the flap component is secured to the fabric layer via a twist tie, a snap, a button, or a hook and loop fastener.

5. The all-purpose face mask device of claim 4, wherein the flap component is secured in an open configuration when the user is consuming food and beverages.

6. The all-purpose face mask device of claim 5, wherein in the open configuration, the flap component is secured open via a twist tie mechanism, a button, a snap or a hook and loop fastener.

7. The all-purpose face mask device of claim 1, wherein the fabric layer comprises a top edge, opposing side edges, and a chin cover to provide complete protection to the user.

8. The all-purpose face mask device of claim 1, wherein the inner layer is configured to contact a user's nose and mouth and the outer layer is disposed on the inner layer and has shape and contour similar to the inner layer.

9. An all-purpose face mask device that reduces the spread of harmful airborne pathogens, the all-purpose face mask device comprising:

a fabric layer comprises a top edge, opposing side edges, and a chin cover to provide complete protection to a user;

two adjustable ear loops secured to the fabric layer;

an opening in the fabric layer which is horizontally positioned, aligning with a width of a user's mouth; and a flap component for closing the opening;

wherein the two adjustable ear loops are configured to be placed around a user's ears to secure the fabric layer in place on a user;

wherein the all-purpose face mask device is configured to cover a nose and a mouth area of a user;

wherein in a closed configuration, the flap component is secured to the fabric layer via a twist tie, a snap, a button or a hook and loop fastener;

wherein the flap component is secured in an open configuration when the user is consuming food and beverages;

wherein in the open configuration, the flap component is secured open via a twist tie mechanism, a button, a snap or a hook and loop fastener; and further when in place, the user consumes food and beverages without fully removing the all-purpose face mask device; wherein the fabric layer comprises inner and outer layers consisting of a plurality of indicia, an anti-bacterial or anti-microbial coating to ensure protection from airborne pathogen entry, a plurality of design pleats for flexibility, and a filter pocket that houses at least one filter.

10. A method of reducing chance of spreading harmful airborne pathogens while consuming food and beverages, the method comprising steps of:

providing a face mask device comprising a fabric layer, an adjustable right and left ear loop, and an opening positioned near the mouth of a user when the face mask is worn, which is ell closed with a flap component;

positioning the face mask device on a user's face with the ear loops secured behind a user's ears;

securing the flap component in an open configuration via a securing means; and eating food or drinking beverages while wearing the all-purpose face mask device; wherein the fabric layer consists of a plurality of indicia, an anti-bacterial or anti-microbial coating to ensure protection from airborne pathogen entry, a plurality of design pleats for flexibility, and a filter pocket that houses at least one filter.

* * * * *